US007199324B2

(12) United States Patent
Perret

(10) Patent No.: US 7,199,324 B2
(45) Date of Patent: Apr. 3, 2007

(54) HIGH-VOLTAGE HYBRID CIRCUIT-BREAKER

(75) Inventor: Michel Perret, Tramole (FR)

(73) Assignee: Areva T & D SA, Paris la Defense (FR)

( * ) Notice: Subject to any disclaimer, the term of this patent is extended or adjusted under 35 U.S.C. 154(b) by 0 days.

(21) Appl. No.: 11/090,434

(22) Filed: Mar. 25, 2005

(65) Prior Publication Data

US 2005/0211675 A1 Sep. 29, 2005

(30) Foreign Application Priority Data

Mar. 25, 2004 (FR) ..... 04 50588

(51) Int. Cl.
*H01H 9/40* (2006.01)

(52) U.S. Cl. ..... 218/3; 218/7; 218/154

(58) Field of Classification Search ..... 218/1, 218/2, 3–10, 12–14, 43–47, 67, 69–71, 76, 218/78, 84, 118–120, 140, 153, 154
See application file for complete search history.

(56) References Cited

U.S. PATENT DOCUMENTS 3,571,543 A * 3/1971 Perkins et al. ..... 218/10
4,458,119 A * 7/1984 Hashimoto et al. ..... 218/3
5,644,117 A 7/1997 Bolongeat-Mobleu et al.
5,905,242 A * 5/1999 Bernard et al. ..... 218/16
6,593,538 B2 * 7/2003 Perret et al. ..... 218/3
2002/0195425 A1 * 12/2002 Perret et al. ..... 218/43

FOREIGN PATENT DOCUMENTS

EP 0 680 063 A1 4/1995
EP 1 020 970 A1 7/2000
WO WO 97/08723 3/1997

* cited by examiner

*Primary Examiner*—Elvin Enad
*Assistant Examiner*—M. Fishman
(74) *Attorney, Agent, or Firm*—Thelen Reid Brown Raysman & Steiner LLP

(57) ABSTRACT

The invention relates to a hybrid circuit-breaker which, for each pole, comprises a dielectric-gas interrupting chamber (1) which contains a first contact (1A) and a moving second contact (1B) that are disposed longitudinally to a first axis (AA') and in which the first contact (1A) is connected to a first terminal (3A) of the network, said interrupting chamber (1) being connected in series with a vacuum bottle (2) which contains a fixed contact (2A) and a moving contact (2B) that are disposed longitudinally to a second axis (BB') and in which the fixed contact (2A) is connected to a second terminal (3B) of the network, actuating means acting via a single control (4) to move said moving contacts between respective open positions and respective closed positions. According to the invention, said actuating means comprise a re-closure arrangement for re-closing the moving contact (2B) of the vacuum bottle, which re-closure arrangement enables said single control (4) to perform such re-closure before the moving contact (1B) of said interrupting chamber reaches its open position.

14 Claims, 8 Drawing Sheets

HIGH-VOLTAGE HYBRID CIRCUIT-BREAKER

CROSS-REFERENCE TO RELATED APPLICATION

This application claims priority to French Application No. 04 50588, filed on Mar. 25, 2004, entitled: "A High-Voltage Hybrid Circuit-Breaker" by Michel PERRET and was not published in English.

BACKGROUND OF THE INVENTION (1) Field of the Invention

The present invention relates to high-voltage circuit devices. More specifically, the present invention relates to a high-voltage hybrid circuit-breaker.

(2) Description of Related Art

The present invention relates to a high-voltage hybrid circuit-breaker.

Such a hybrid circuit-breaker comprises one interrupting chamber for each pole, which interrupting chamber uses a dielectric gas, e.g. sulfur hexafluoride ($SF_6$) under pressure, and has its fixed contact connected to a first terminal of the network and connected in series with a switch that withstands the dU/dt of the re-establishment voltage transient, and that has its fixed contact connected to a second terminal of the network. The switch is often a so-called vacuum "bottle".

Such a hybrid circuit-breaker having metal cladding and commonly referred to as being "metal-clad" is described in U.S. Pat. No. 4,458,119 in which the interrupting chamber and the bottle are connected in series and in alignment. In that circuit-breaker, the moving contacts of the chamber and of the bottle are connected to actuating means for moving them between respective open positions and respective closed positions by means of a single control. Those actuating means comprise a set of links for opening the contacts of the vacuum bottle before the contacts of the gas interrupting chamber are opened. Such a delay is, in general, about a few milliseconds (ms). It is caused by the stroke of the moving contact being shorter in the vacuum bottle than in the interrupting chamber.

That type of hybrid circuit-breaker raises the following technical problems.

Firstly, since the interrupting elements are in alignment, it is particularly voluminous.

In addition, its actuating means do not enable the delay to be adjusted easily. However, depending on the power of the hybrid circuit-breaker or depending on the dielectric gas used, it can be useful to adjust the length of a delay between opening of the interrupting chamber and opening of the bottle.

In order to solve those problems, it is possible to consider disposing the gas interrupting chamber and the vacuum bottle along two sloping axes, the moving contact of the interrupting chamber being extended by a longitudinal drive arrangement against which an element connected to the moving contact of the vacuum bottle is disposed in permanent contact, the single control urging the moving contact of the interrupting chamber to move in translation along the first axis, and the length and the shape of the drive arrangement guaranteeing that the moving contacts move in synchronized manner from their closed positions to their open positions and vice versa.

Such an arrangement for a hybrid circuit-breaker is described in patent Documents U.S. 2003/0089682 or WO 97/08723.

Unfortunately, such arrangements raise the following technical problems.

Once the moving contacts of the interrupting chamber and of the vacuum bottle are in their open positions, the interrupting chamber and the vacuum bottle remain in their open positions. However, in those open positions, all of the moving contacts and of the charged parts that are integral with or secured to them form an assembly that is at a "floating" potential, that behaves like a capacitor, and that can give rise to partial discharges that might degrade the circuit-breaker, e.g. in the live insulating parts, in particular when the voltage across the terminals of the circuit-breaker is high. That can lead to arcs re-striking, essentially due to the short distance between the contacts of the vacuum bottle.

That problem can generally be solved by installing disconnectors connected in series with the circuit-breaker.

However, if such additional installation is omitted, the performance of the circuit-breaker and its length of its life are adversely affected.

SUMMARY OF THE INVENTION

To solve that problem, the invention provides a hybrid circuit-breaker which, for each pole, comprises a dielectric-gas interrupting chamber which contains a first contact and a moving second contact that are disposed longitudinally to a first axis and in which the first contact is connected to a first terminal of the network, said interrupting chamber being connected in series with a vacuum bottle which contains a fixed contact and a moving contact that are disposed longitudinally to a second axis and in which the fixed contact is connected to a second terminal of the network, actuating means acting via a single control to move said moving contacts between respective open positions and respective closed positions, said hybrid circuit-breaker being characterized in that said actuating means comprise a re-closure arrangement for re-closing the moving contact of the vacuum bottle, which re-closure arrangement enables said single control to perform such re-closure before the moving contact of said interrupting chamber reaches its open position.

An important characteristic of the invention is that the vacuum bottle is re-closed by the same single control that opens and closes the contacts, thereby making it possible for the control arrangement to be particularly light in weight. This results in a smaller number of parts, a lower cost, and a shorter assembly time.

In a preferred embodiment, said actuating means comprise an arrangement for moving the moving contact of said interrupting chamber over a distance greater than the distance between the contacts of the interrupting chamber in the open position.

By means of this characteristic of the invention, the contacts of the interrupting chamber are spaced apart by a distance greater than the distance necessary for it to act as a circuit-breaker, and, beyond this open position, the interrupting chamber can act as a disconnector.

This is particularly advantageous for making it unnecessary to connect a separate disconnector in series as is usually necessary, in order to avoid any possibility of arcs re-striking even in the event that gas leaks occur.

According to another characteristic of the invention, the hybrid circuit-breaker further comprises a grounding arrangement for grounding the second terminal, which grounding arrangement is actuated by said single control.

This other characteristic of the invention further increases the ease with which the hybrid circuit-breaker can be controlled automatically and in synchronized manner. In known manner, the grounding arrangement is an element that is in separate cladding and that is provided with a specific control. The circuit-breaker of the invention is thus optimized in terms of the materials used and thus of the cost.

In a particular and preferred embodiment, said two axes are substantially perpendicular, said moving contact of the interrupting chamber is extended by a longitudinal drive arrangement against which an element connected to the moving contact of the vacuum bottle is disposed, and said single control urges said moving contact of the interrupting chamber to move in translation along said first axis, the length and the shape of said drive arrangement guaranteeing that the movements of said moving contacts are synchronized.

In a first variant, said longitudinal drive arrangement is formed by a slideway having two mutually parallel rolling bearing surfaces, said element connected to the moving contact of the vacuum bottle being disposed in said slideway and being permanently in contact with one or the other of the two rolling bearing surfaces.

In a second variant, said longitudinal drive arrangement is formed by a cam, said element connected to the moving contact of the vacuum bottle being suitable for pressing against the rolling bearing surface of said cam on that side of said cam which faces away from the bottle when the control for controlling the means for actuating the hybrid circuit-breaker is activated.

In order to open the vacuum bottle a few ms after the interrupting chamber is opened, said slideway or said cam includes a first segment parallel to the first axis, disposed closer to said control, and extended at its end closer to the moving contact of the interrupting chamber by a second segment that slopes away from the moving contact of the vacuum bottle, which second segment is itself extended at its end closer to the moving contact of the interrupting chamber by a third segment parallel to the first axis, which third segment is extended by a fourth segment sloping towards the moving contact of the vacuum bottle, which segment is itself extended at the end closer to the moving contact of the interrupting chamber by a fifth segment parallel to the first axis.

By appropriately choosing the angle of inclination of the second segment, it is possible to adjust the speed of separation of the contacts of the vacuum bottle.

Said fifth segment performs the function of re-closing the vacuum bottle.

In order for the interrupting chamber to act as a disconnector, said fifth segment is of length greater than the distance between the contacts of the interrupting chamber at the end of the open position.

In a first variant, in order to perform the automatic grounding function, said grounding arrangement is driven by a link of which an integral element is disposed in said slideway or against the rolling bearing surface of said cam, said link moving in translation while said integral element goes into the second segment causing a contact that is electrically connected to said vacuum bottle to move into a grounded contact member.

In a second variant, in order to perform the automatic grounding function, said grounding arrangement is constituted by a contact disposed at that end of the longitudinal drive arrangement which is closer to the control, and coming into a grounded contact member at the end of the opening stroke of the moving contact of the interrupting chamber.

Preferably, an arrangement having a mechanical spring is disposed substantially along the second axis to apply pressure in the closed position.

Said spring of said arrangement is advantageously disposed outside a casing which encloses said longitudinal drive arrangement.

In a preferred use, the circuit-breaker of the invention is "metal-clad", i.e. it has grounded metal cladding.

Said grounded contact member may be a thimble contact mounted on said cladding.

BRIEF DESCRIPTION OF THE DRAWINGS

The invention is described below in more detail with reference to the figures which show merely preferred embodiments of the invention, and in which.

DETAILED DESCRIPTION OF THE INVENTION

Figure 1:
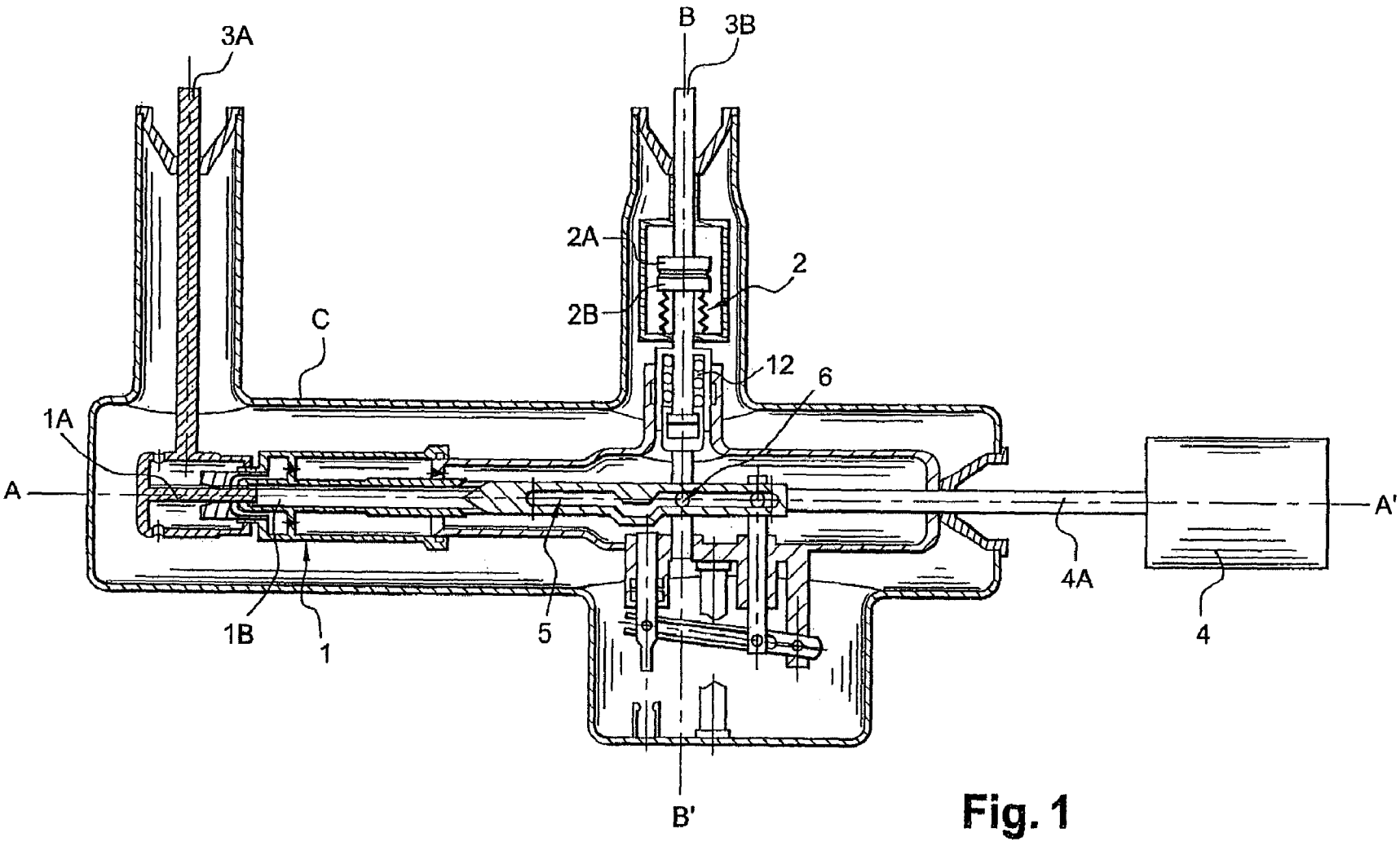
FIGS. 1 to 4 are longitudinal section views of a first embodiment of a metal-clad circuit-breaker of the invention, in various positions during opening.

In a manner common to all of the embodiments described, for each pole, a hybrid circuit-breaker comprises an interrupting chamber 1 using a dielectric gas, e.g. sulfur hexafluoride ($SF_6$) under pressure, and further containing a fixed contact 1A and a moving contact 1B that are disposed longitudinally to a first axis AA' that is horizontal as seen in the figures, and in which the fixed contact 1A is connected to a first terminal 3A of the network. The interrupting chamber 1 is connected in series with a vacuum bottle 2 containing a fixed contact 2A and a moving contact 2B that are disposed longitudinally to a second axis BB' that is vertical as seen in the figures, and in which the first contact 2A is connected to a second terminal 3B of the network.

Actuating means act via a single control 4 to move the moving contacts 1B and 2B between respective open positions and respective closed positions.

The actuating means comprise an arrangement for re-closing the moving contact 2B of the vacuum bottle 2 so that the single control 4 performs such re-closure before the moving contact in the interrupting chamber 1 reaches its open position.

They further comprise an arrangement for moving the moving contact 1B of the interrupting chamber 1 over a distance greater than the distance between the contacts 1A and 1B of the interrupting chamber at the end of the open position.

The hybrid circuit-breaker further includes an automatic grounding arrangement actuated by the single control 4.

In order to form the actuating means, the two axes AA' and BB' are thus substantially perpendicular and the moving contact 1B of the interrupting chamber 1 is extended by a longitudinal drive arrangement referred to as a "slideway"

and against which an element connected to the moving contact 2B of the vacuum bottle is disposed in permanent contact, and the single control 4 urges the moving contact 1B of the interrupting chamber 1 to move in translation along the first axis AA', the length and the shape of the drive arrangement guaranteeing that the moving contacts 1B and 2B move in synchronized manner.

A first embodiment is described below with reference to FIGS. 1 to 4, which show a metal-clad hybrid circuit-breaker having metal cladding C that is grounded.

In this example, the slideway is formed by a groove 5 provided in a piece extending the moving contact 1B and connecting said contact to the control link 4A, and the element connected to the moving contact 2B of the vacuum bottle 2 is a lug or peg 6 that is perpendicular to the second axis BB' and that is engaged in said groove 5.

In order to achieve the desired synchronization of the moving contacts 1B and 2B, the groove 5 is shaped as follows.

In order to perform the function of opening the vacuum bottle 2 with a delay of a few ms relative to opening of the interrupting chamber 1, the groove has a first segment 5A parallel to the first axis AA', disposed closer to the control 4 and extended at its end closer to the moving contact 1B of the interrupting chamber 1 by a second segment 5B that slopes away from the moving contact 2B of the vacuum bottle 2, which second segment is itself extended at its end closer to the moving contact 2B of the interrupting chamber 2 by a third segment 5C parallel to the first axis AA'.

An advantage of the invention appears here. Generally, the opening delay is about 3 ms. However, depending on the power of the circuit-breaker and depending on the dielectric gas used in the interrupting chamber, it can be necessary for said delay to take a different value. By using the actuating means of the invention, it is easy to make such an adjustment and to install an element having a groove adapted to match needs.

In order to perform the function of re-closing the vacuum bottle 2, the groove 5 is extended by a fourth segment 5D sloping towards the moving contact 2B of the vacuum bottle 2, which segment is itself extended at the end closer to the moving contact 1B of the interrupting chamber 1 by a fifth segment 5E parallel to the first axis AA'.

In order to perform the disconnector function of the interrupting chamber 1, the fifth segment 5E is of length greater than the distance between the contacts 1A and 1B of the interrupting chamber 1 as performing its circuit-breaker function and as in its open position.

In order to perform the automatic grounding function for automatically grounding the second terminal 3B, a grounding arrangement is driven by a link 7 of which an integral element, namely a lug or peg 7A, is engaged in an extension to the first segment 5A of the groove 5, said link 7 moving in translation while said integral element 7A is going into the second segment 5B causing a contact 8 electrically connected to the interrupting chamber 1 to move into a contact member 9 connected to ground, which contact member is a thimble contact mounted on the cladding C in this example.

More precisely, the link 7 is mounted to slide vertically in a fixed casing 10 and, at its end that is external to said casing 10, it is engaged in a longitudinal groove in a second link 11 that is mounted to pivot at its end on a fixed and horizontal pin 14 carried by the casing 10. A lug or peg integral with the contact 8 is engaged in same groove, said contact 8 being mounted to slide vertically in the casing 10 with sliding electrical contacts being interposed.

In addition, in order to press the contacts 2A and 2B of the vacuum bottle closed, a presser arrangement 12 is interposed between the moving contact 2B of the vacuum bottle 2 and the peg or lug 6 connected to the contact 2B. In this example, the arrangement is an arrangement having a mechanical spring 13.

Said arrangement is constituted by a radial extension 12A of the moving contact 2B of the bottle 2, which extension can move in translation in a cylindrical opening in the casing 10, with sliding contacts being interposed, and forms a recess for receiving the mechanical spring 13 against the end of which an annular piston 12B comes into contact, the stroke in translation of the annular piston being limited by it coming into abutment against a flange on the moving contact 2B. The piston 12B carries the lug or peg 6. By means of its rating, the spring 13 presses together the contacts 2A and 2B of the bottle 2 in their closed position.

An opening cycle is described below. Below, any reference to "vertical" or "horizontal", "right" or "left", "top" or "bottom" is to be considered as seen in the figures.

As shown in FIG. 1, the circuit-breaker is in the closed position, the contacts 1A and 1B of the interrupting chamber 1 and the contacts 2A and 2B of the vacuum bottle 2 being closed. The pegs 6 and 7A are in the horizontal first segment 5A in the groove. The grounding arrangement is in the inactive position.

Figure 2:
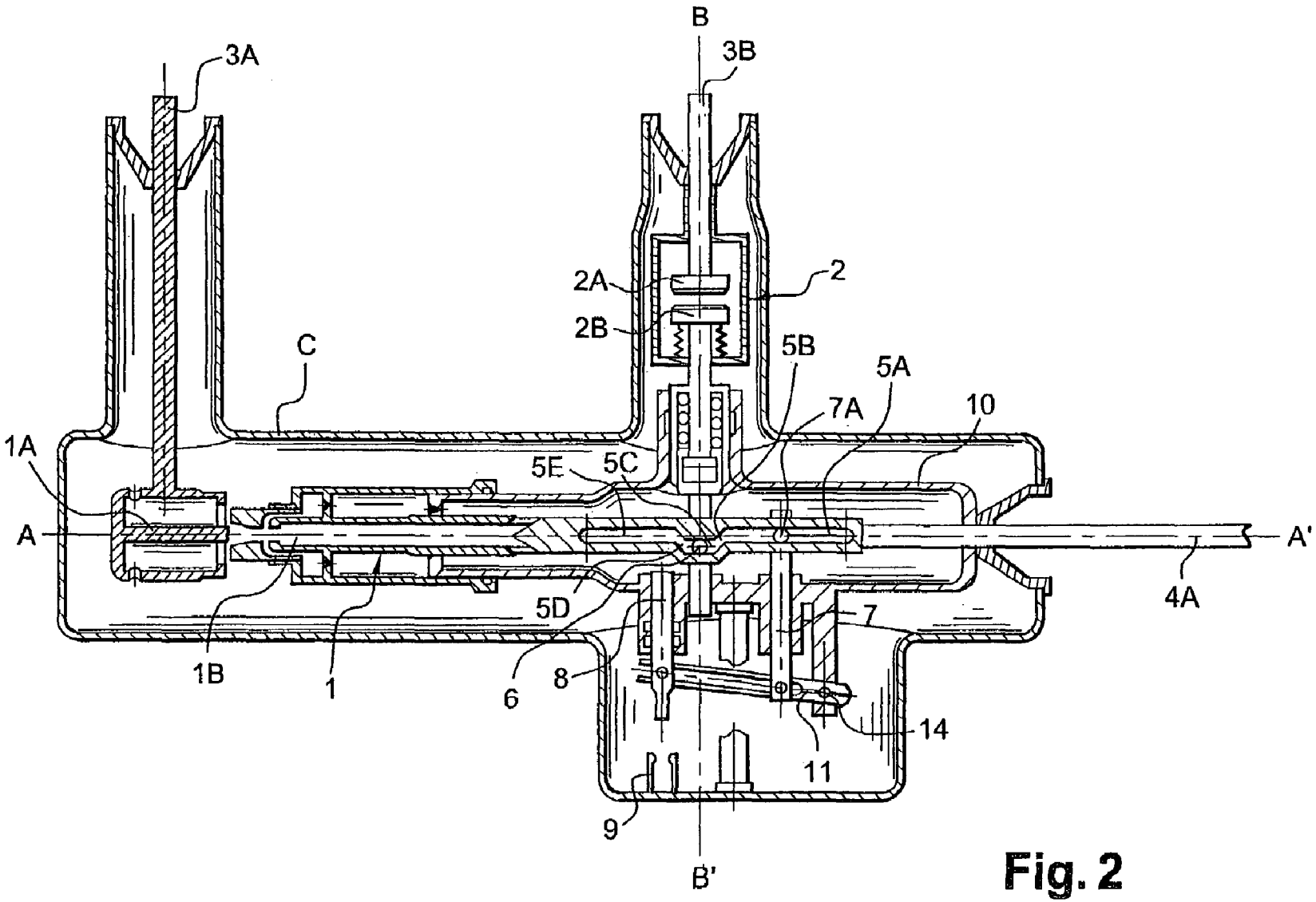

Via the control 4, the opening cycle starts, and the control link 4A is pulled rightwards. After a first stroke in the first segment 5A over which the contacts 1A and 1B of the interrupting chamber 1 are separated and over which the contacts 2A and 2B of the vacuum bottle remain closed, then, during a first stage, as shown in FIG. 2, the peg 6 on the vacuum bottle 2 descends by means of the second segment 5B of the groove 5, thereby causing the contacts 2A and 2B of the bottle to open in delayed manner. Then, by going into the third segment 5C, the opening of the contacts 1A and 1B of the interrupting chamber is finished off with the arc being blasted, in a manner known per Se. The peg 7A on the grounding link 7 is still in the first segment 5A of the groove 5 and the grounding arrangement is still in the inactive position.

Figure 3:
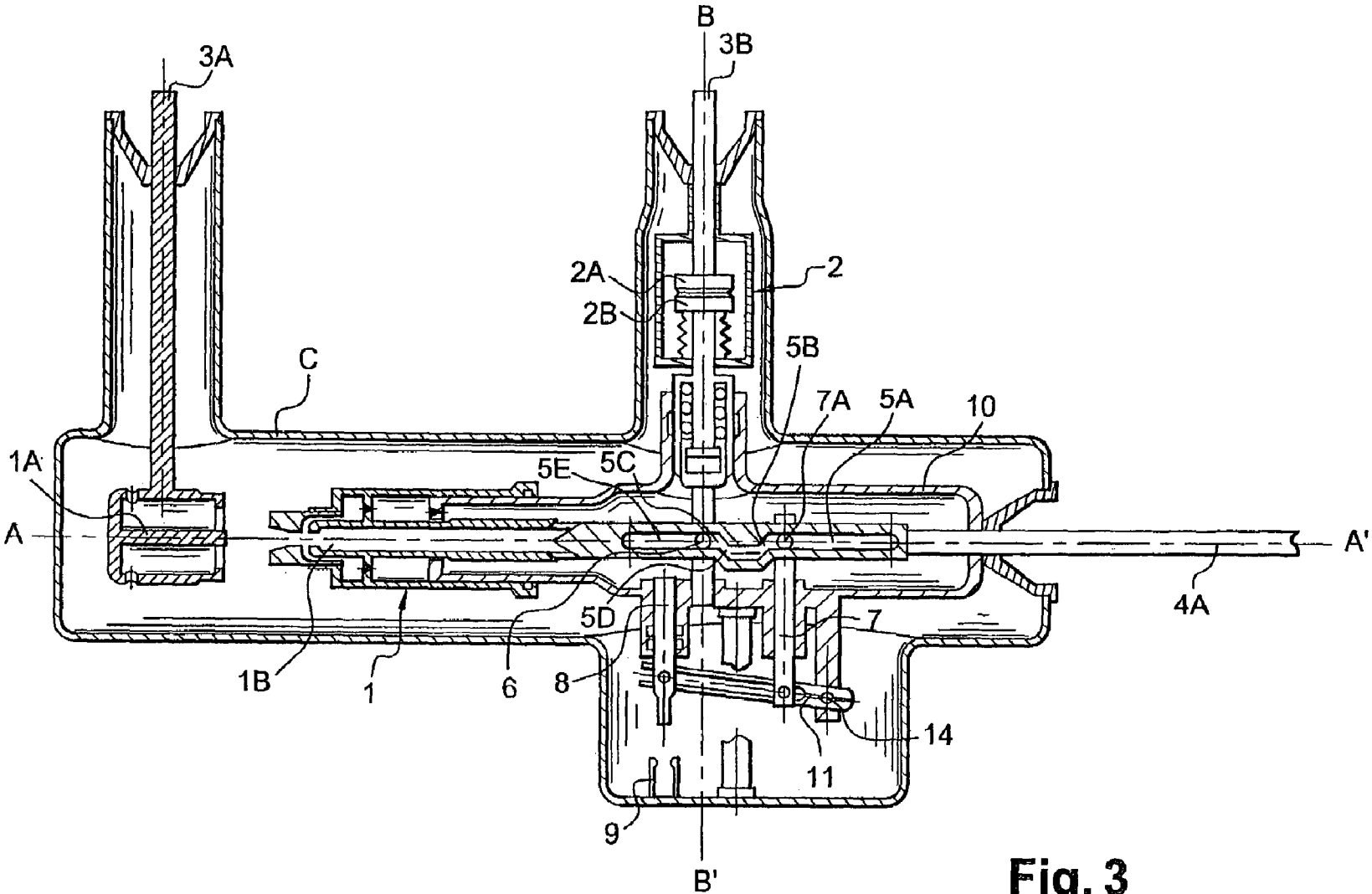

The contacts 1A and 1B of the interrupting chamber 1 continue to separate while the peg 6 rises via the fourth segment 5D of the groove 5, thereby re-closing the vacuum bottle, as shown in FIG. 3. In this position, the interrupting chamber 1 acts as a circuit-breaker. The peg 7A on the grounding link 7 is still in the first segment 5A, and the grounding arrangement is still in the inactive position.

Figure 4:
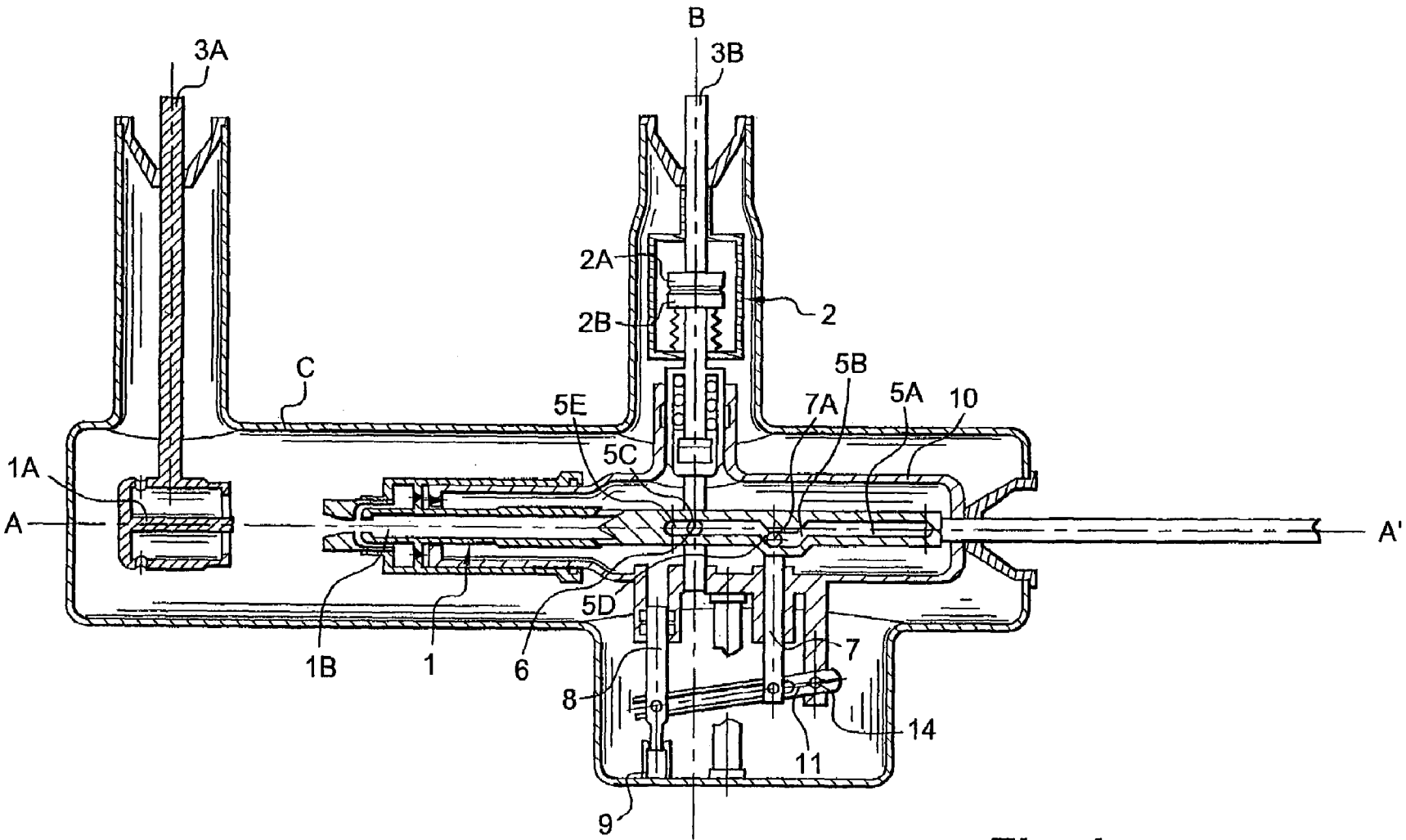

With the vacuum bottle 2 closed, the peg 6 then moves along the fifth segment 5E of the groove 5, and the contacts 1A and 1B of the interrupting chamber 1 continue to open beyond its open position to a position shown in FIG. 4 in which it acts as a disconnector. During this movement, the peg 7A of the grounding link 7 descends by going down the second segment 5B of the groove 5, and also drives the contact 8 downwards via the grooved link 11, and, at the end of the stroke, the grounding arrangement is in the active position, with the contact 8 electrically connected to the thimble contact 9 mounted on the casing C.

Figure 5:
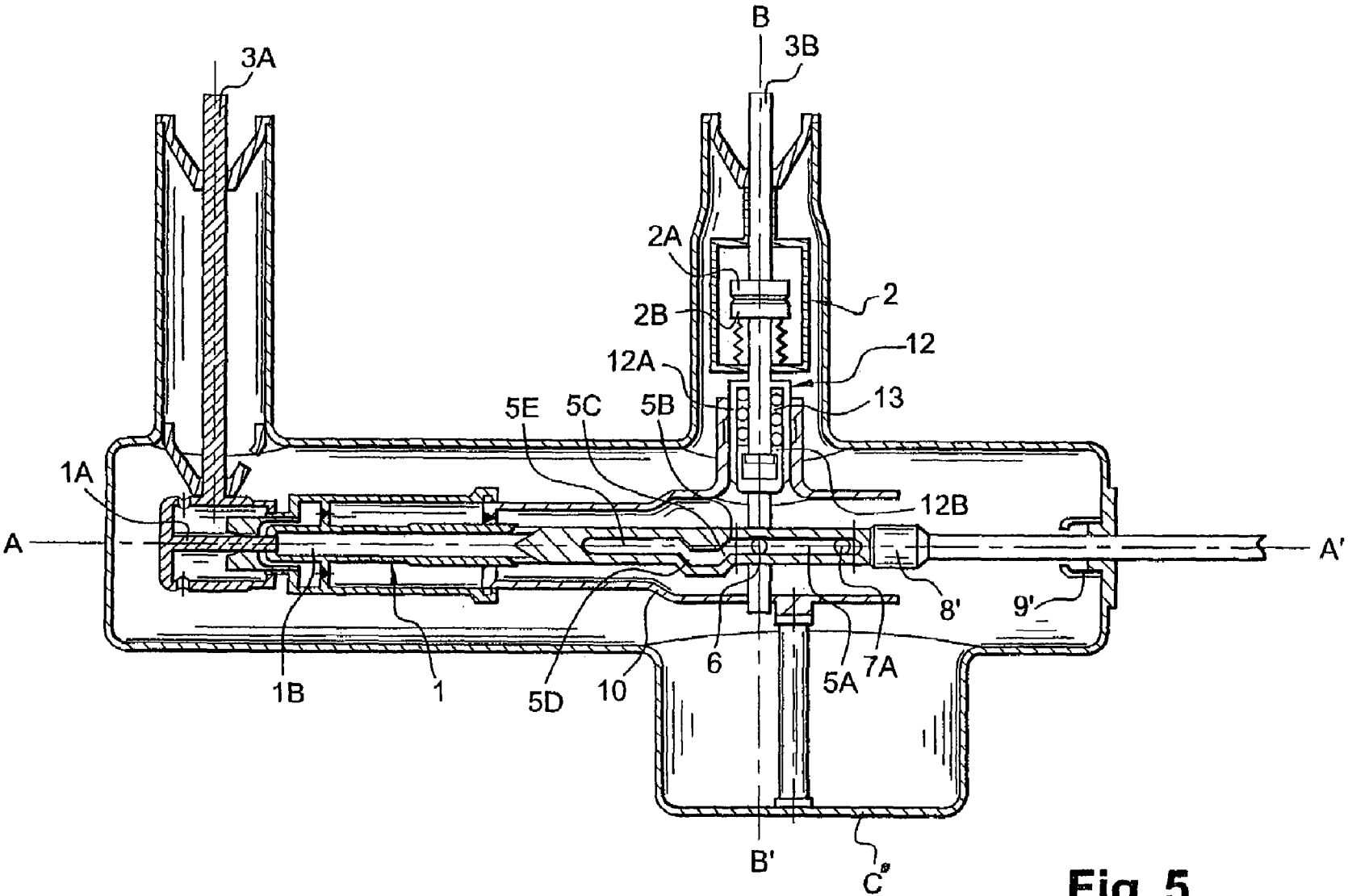
FIG. 5 is a longitudinal section view of a second embodiment of a metal-clad hybrid circuit-breaker of the invention, in the closed position.

FIG. 5 shows a second embodiment including a variant embodiment of the automatic grounding arrangement.

In this example, at its end closer to the control 4, the longitudinal drive arrangement or slideway carries a contact 8' having a longitudinal axis AA', and the distance between the contact 8' and the cladding C which carries a grounded contact 9' that is preferably of the thimble contact type, is such that, at the end of the stroke over which the control link 4A moves longitudinally, into the position in which the interrupting chamber acts as a disconnector, said contact 8' comes into electrical contact with the thimble contact 9', thereby providing grounding.

Figure 6:
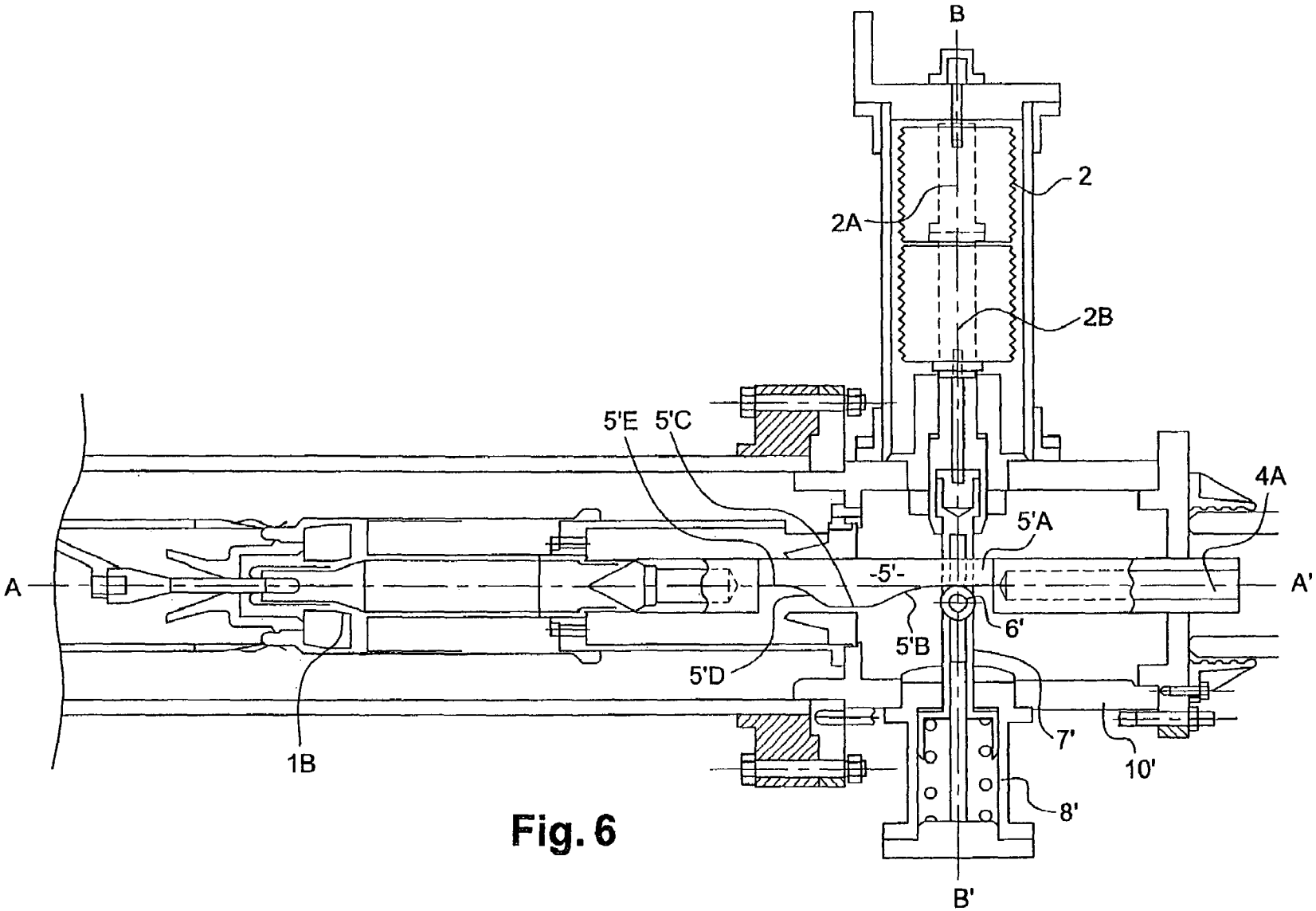
FIG. 6 is a fragmentary longitudinal section view of a third embodiment of a metal-clad hybrid circuit-breaker of the invention, in the closed position.

FIG. 6 shows a third embodiment of the invention, in the closed position, and including another variant of the drive means.

In this example, the slideway is formed by a link 5' extending the moving contact 1B and connecting said moving contact to the control link 4A, and the element connected to the moving contact 2B of the vacuum bottle 2 is a lug or peg 6' that is perpendicular to the second axis BB' and that rolls against the slideway link 5'. The link 5' comprises segments 5'A to 5'E analogous to the above-described segments in the first embodiment which has a groove 5 and which operates identically.

The peg 6' carries a rolling bearing and is inserted between the bottom face or generator line of the link 5' and a piece 7' connected to the moving contact 2B of the vacuum bottle 2. The piece 7' is a clevis-shaped piece and is advantageously held in sliding contact by a support 8' carried by the casing 10.

Figure 7:
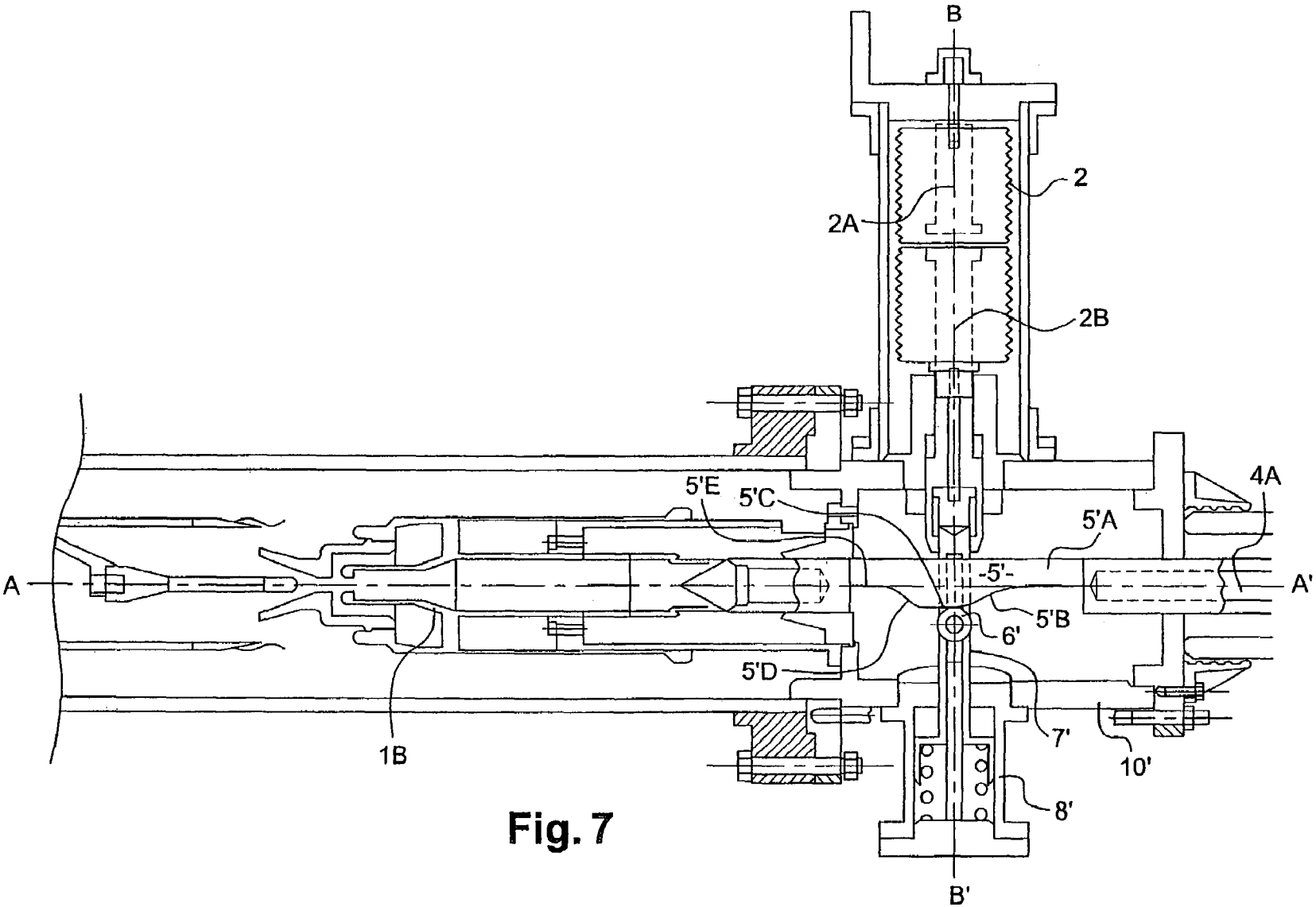
FIGS. 7 and 8 are fragmentary longitudinal section views of a third embodiment of a hybrid circuit-breaker of the invention in an insulating casing, in various positions during opening.
Figure 8:
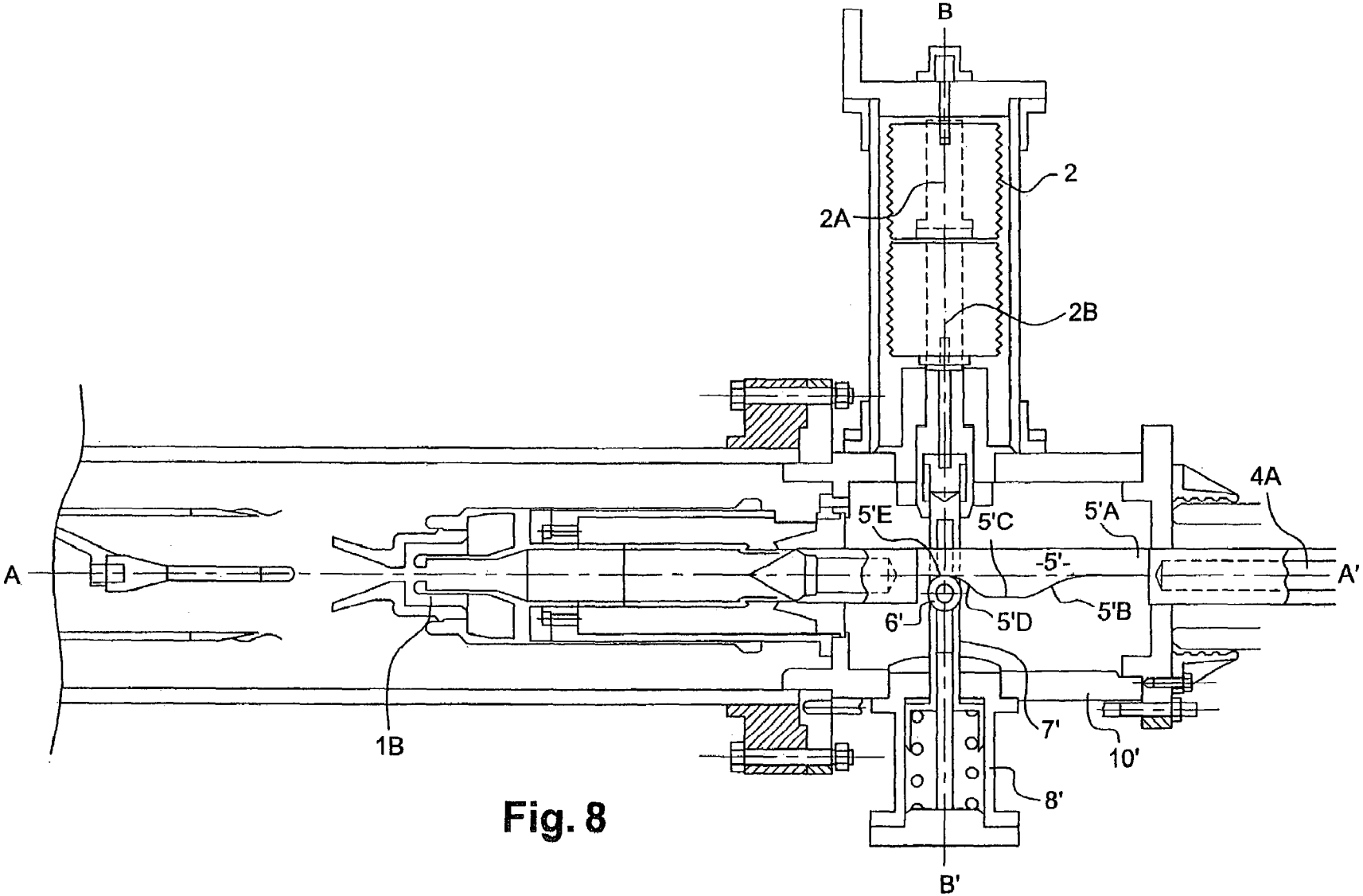

FIGS. 7 and 8 are fragmentary views showing such a circuit-breaker during an opening cycle.

An opening cycle by means of these variants is described below.

As shown in FIG. 6, the circuit-breaker is in the closed position, the contacts 1A and 1B of the interrupting chamber 1 and the contacts 2A and 2B of the vacuum bottle 2 being closed. The peg 6' is in contact with the horizontal first segment 5'A of the slideway link 5'.

By means of the control 4, the opening cycle starts, and the control link 4A is pulled rightwards. After a first stroke along the first segment 5'A over which the contacts 1A and 1B are separated, then, in a first stage, the peg 6' on the vacuum bottle 2 descends by means of the second segment 5'B of the link 5', thereby opening the contacts 2A and 2B of said bottle in delayed manner, as shown in FIG. 7. Then, by going along the third segment 5'C, the opening of the contacts 1A and 1B of the interrupting chamber 1 is finished off with blasting, in a manner known per Se.

The contacts 1A and 1B of the interrupting chamber 1 continue to separate, while the peg 6' rises via the fourth segment 5'D of the link 5', thereby re-closing the vacuum bottle, as shown in FIG. 8. In this position, the interrupting chamber 1 acts as a circuit-breaker.

With the vacuum bottle 2 closed, the peg 6' then moves along the fifth segment 5'E of the link 5' and the contacts 1A and 1B of the interrupting chamber 1 continue to separate beyond its open position to a position in which it acts as a disconnector.

As illustrated above, the invention is applicable to any type of hybrid circuit-breaker, be it metal-clad or air-insulated.

The invention claimed is:

1. A hybrid circuit-breaker comprises a dielectric-gas interrupting chamber (1) which contains a first contact (1A) and a moving second contact (1B) that are disposed longitudinally to a first axis (AA') and in which the first contact (1A) is connected to a first terminal (3A) of a network, said interrupting chamber (1) being connected in series with a vacuum bottle (2) which contains a fixed contact (2A) and a moving contact (2B) that are disposed longitudinally to a second axis (BB') and in which the fixed contact (2A) is connected to a second terminal (3B) of the network, actuating means acting via a single control (4) to move said moving contacts between respective open positions and respective closed positions, said hybrid circuit-breaker being configured to include a re-closure arrangement for performing a re-closing movement between the moving contact (2B) and the fixed contact (2A) of the vacuum bottle, wherein said single control (4) enables said re-closure arrangement to perform said re-closing movement when said moving contact (1B) of said interrupting chamber is moving away from said first contact (1A).

2. A hybrid circuit-breaker according to claim 1, characterized in that said actuating means comprise an arrangement for moving the moving contact (1B) of said interrupting chamber over a distance greater than the distance between the contacts of the interrupting chamber (1) at the end of the open position.

3. A circuit-breaker according to claim 1, characterized in that it further comprises a grounding arrangement for grounding the second terminal (3B), which grounding arrangement is actuated by said single control (4).

4. A circuit-breaker according to claim 1, characterized in that said two axes (AA', BB') are substantially perpendicular, said moving contact (1B) of the interrupting chamber is extended by a longitudinal drive arrangement against which an element (6, 6') connected to the moving contact (2B) of the vacuum bottle is disposed, and said single control (4) urges said moving contact (1B) of the interrupting chamber to move in translation along said first axis (AA'), the length and the shape of said drive arrangement guaranteeing that the movements of said moving contacts are synchronized.

5. A circuit-breaker according to claim 4, characterized in that said longitudinal drive arrangement is formed by a slideway (5) having two mutually parallel rolling bearing surfaces, said element (6, 6') connected to the moving contact (2B) of the vacuum bottle being disposed in said slideway and being continuously in contact with one or the other of the two rolling bearing surfaces.

6. A circuit-breaker according to claim 4, characterized in that said longitudinal drive arrangement is formed by a cam (5'), said element (6, 6') connected to the moving contact (2B) of the vacuum bottle being suitable for pressing against the rolling bearing surface of said cam on that side of said cam which faces away from the bottle (2) when the control (4) for controlling the means for actuating the hybrid circuit-breaker is activated.

7. A circuit-breaker comprises:

a dielectric-gas interrupting chamber (1) which contains a first contact (1A) and a moving second contact (1B) that are disposed longitudinally to a first axis (AA') and in which the first contact (1A) is connected to a first terminal (3A) of a network, said interrupting chamber (1) being connected in series with a vacuum bottle (2) which contains a fixed contact (2A) and a moving contact (2B) that are disposed longitudinally to a second axis (BB') and in which the fixed contact (2A) is connected to a second terminal (3B) of the network, actuating means acting via a single control (4) to move said moving contacts between respective open positions and respective closed positions, wherein said single control (4) enables a re-closure arrangement for performing a re-closing movement between the moving contact (2B) and the fixed contact (2A) of the vacuum bottle when said moving contact (1B) of said interrupting chamber is moving away from said first contact (1A);

wherein said two axes (AA', BB') are substantially perpendicular, said moving contact (1B) of the interrupting chamber is extended by a longitudinal drive arrangement against which an element (6, 6') connected to the moving contact (2B) of the vacuum bottle is disposed, and said single control (4) urges said moving contact (1B) of the interrupting chamber to move in translation along said first axis (AA'), the length and the shape of said drive arrangement guaranteeing that the movements of said moving contacts are synchronized;

wherein said longitudinal drive arrangement is formed by a slideway (5) having two mutually parallel rolling bearing surfaces, said element (6, 6') connected to the moving contact (2B) of the vacuum bottle being disposed in said slideway and being continuously in contact with one or the other of the two rolling bearing surfaces;

wherein said slideway (5, 5') includes a first segment (5A, 5'A) parallel to the first axis (AA'), disposed closer to said control (4), and extended at its end closer to the moving contact (1B) of the interrupting chamber by a second segment (5B, 5'B) that slopes away from the moving contact (2B) of the vacuum bottle, which second segment is itself extended at its end closer to the moving contact (2B) of the interrupting chamber by a third segment (5C, 5'C) parallel to the first axis (AA'), which third segment is extended by a fourth segment (5D,5'D) sloping towards the moving contact (2B) of the vacuum bottle, which segment is itself extended at the end closer to the moving contact (1B) of the interrupting chamber by a fifth segment (5E, 5'E) parallel to the first axis (AA').

8. A circuit-breaker according to claim 7, characterized in that said fifth segment (5E, 5'E) is of length greater than the distance between the contacts of the interrupting chamber (1) when acting as a circuit-breaker and in the open position.

9. A circuit-breaker according to claim 3, wherein said grounding arrangement is driven by a link (7) of which an integral element (7A) is disposed in said slideway or against the rolling bearing surface of a cam, said link (7) moving in translation while said integral element (7A) goes into the second segment (5A, 5'A) causing a contact (8) that is electrically connected to said vacuum bottle (2) to move into a grounded contact member (9).

10. A circuit-breaker according to claim 3, wherein said grounding arrangement includes a contact (8') situated between a slideway and the control (4), said contact (8') configured to come in contact with a grounded contact member (9') at the end of the opening stroke of the moving contact (1B) of the interrupting chamber.

11. A circuit-breaker according to claim 1, characterized in that an arrangement (12) having a mechanical spring (13) is disposed substantially along the second axis (B–B') to apply pressure in the closed position.

12. A circuit-breaker according to claim 11, characterized in that the spring (13) of said arrangement is disposed outside a casing which encloses said longitudinal drive arrangement.

13. A circuit-breaker according to claim 1, further comprising metal-clad, wherein the metal-clad includes grounded metal cladding.

14. A circuit-breaker according to claim 9, characterized in that said grounded contact member is a thimble contact (8, 8') mounted on said cladding.

* * * * *